US008042211B2

(12) United States Patent
Stansel et al.

(10) Patent No.: US 8,042,211 B2
(45) Date of Patent: Oct. 25, 2011

(54) METHOD OF DETECTING AN OFF-BALANCE CONDITION OF A CLOTHES LOAD IN A WASHING MACHINE

(75) Inventors: Andrew C. Stansel, St. Joseph, MI (US); Manoel Francisco Soares Neto, St. Joseph, MI (US); Jason L. Clemons, St. Joseph, MI (US); Bennett J. Cook, Watervliet, MI (US); Adam John Darby, Auckland (NZ)

(73) Assignees: Whirlpool Corporation, Benton Harbor, MI (US); Fisher & Paykel, Auckland (NL)

( * ) Notice: Subject to any disclaimer, the term of this patent is extended or adjusted under 35 U.S.C. 154(b) by 1408 days.

(21) Appl. No.: 11/246,982

(22) Filed: Oct. 7, 2005

(65) Prior Publication Data

US 2007/0039106 A1 Feb. 22, 2007

Related U.S. Application Data

(60) Provisional application No. 60/595,914, filed on Aug. 16, 2005.

(51) Int. Cl.
*D06F 33/02* (2006.01)
*D06F 37/20* (2006.01)

(52) U.S. Cl. ..... 8/159; 68/12.06

(58) Field of Classification Search ..... 8/159
See application file for complete search history.

(56) References Cited

U.S. PATENT DOCUMENTS

| | | | | |
|---|---|---|---|---|
| 4,411,644 | A | 10/1983 | Tinklenberg | 493/213 |
| 4,765,161 | A | 8/1988 | Williamson | 68/12 R |
| 5,181,398 | A | 1/1993 | Tanaka et al. | 68/12.06 |
| 5,301,522 | A | 4/1994 | Ikemizu et al. | 68/12.06 |
| 5,671,494 | A | 9/1997 | Civanelli et al. | 8/159 |
| 5,768,731 | A | 6/1998 | Do | 8/159 |
| 5,907,880 | A | 6/1999 | Durazzani et al. | 8/159 |
| 5,970,555 | A | 10/1999 | Baek et al. | 8/159 |
| 5,979,194 | A | 11/1999 | Matsumoto et al. | 68/12.04 |
| 6,047,428 | A | 4/2000 | Min | 8/159 |
| 6,158,072 | A | 12/2000 | Baek et al. | 8/159 |
| 6,282,965 | B1 | 9/2001 | French et al. | 73/660 |
| 6,382,791 | B1 | 5/2002 | Strawderman et al. | 351/203 |

(Continued)

FOREIGN PATENT DOCUMENTS

| | | | |
|---|---|---|---|
| CN | 1331411 | A | 1/2002 |
| DE | 38212330 | A1 * | 10/1989 |
| DE | 4038178 | A1 * | 6/1992 |
| DE | 4038178 | A1 | 6/1992 |
| DE | 19920604 | A1 * | 6/1992 |

(Continued)

OTHER PUBLICATIONS

English Machine Translation of DE4038178, Henneman, Jun. 1994.*

*Primary Examiner* — Michael Barr

*Assistant Examiner* — Jason Riggleman

(74) *Attorney, Agent, or Firm* — Clifton G. Green; McGarry Bair PC

(57) ABSTRACT

An off-balance detection method comprises a plurality of off-balance detection schemes that utilize wash basket speed to detect an off-balance load condition at speed ranges that span the entire spin cycle and include speeds corresponding to natural frequencies of a mass comprising a wash tub and a wash basket. The schemes can be used alone or in combination with one or more of the other schemes. The off-balance detection method can further comprise a power limiting method to prevent motor overload when an off-balance condition is present.

18 Claims, 16 Drawing Sheets

U.S. PATENT DOCUMENTS

| | | | | |
|---|---|---|---|---|
| 6,393,918 | B2 | 5/2002 | French et al. | 73/660 |
| 6,555,290 | B1 | 4/2003 | Ichakawa et al. | 430/284.1 |
| 6,594,841 | B2 | 7/2003 | Broker et al. | 8/159 |
| 6,715,175 | B2 | 4/2004 | Ciancimino et al. | |
| 2002/0035757 | A1 * | 3/2002 | Ciancimino et al. | 8/159 |
| 2003/0145392 | A1 | 8/2003 | Hird | 8/159 |

FOREIGN PATENT DOCUMENTS

| | | | |
|---|---|---|---|
| EP | 0071308 | A2 | 2/1983 |
| GB | 2174513 | A | 11/1986 |
| GB | 2271837 | A | 4/1994 |
| GB | 2322141 | A | 8/1998 |
| WO | 0028128 | A1 | 5/2000 |

* cited by examiner

| Range | HVDC Range Minimum | HVDC Range Maximum | Maximum Advance Angle |
|---|---|---|---|
| 1 | --- | 335 | 85 |
| 2 | 336 | 345 | 84 |
| 3 | 346 | 357 | 83 |
| 4 | 358 | 368 | 82 |
| 5 | 369 | 379 | 81 |
| 6 | 380 | --- | 80 |

Fig. 15

METHOD OF DETECTING AN OFF-BALANCE CONDITION OF A CLOTHES LOAD IN A WASHING MACHINE

CROSS-REFERENCE TO RELATED APPLICATIONS

This application claims the benefit of U.S. patent application Ser. No. 60/595,914, filed Aug. 16, 2005.

BACKGROUND OF THE INVENTION

1. Field of the Invention

The invention relates to a method of detecting an off-balance condition of a clothes load in a washing machine.

2. Description of the Related Art

Various appliances, such as automatic washing machines, automatic dryers, centrifugal liquid extractors, etc., utilize a rotating tub, basket, or other vessel holding a load of material that can be evenly or unevenly distributed within the vessel. The condition of having the load unevenly distributed, or out of balance, creates a situation where the center of mass of the rotating vessel does not correspond to the rotational axis of the vessel. In a washing machine, as the speed of the vessel increases during a spin extraction cycle, an unbalanced load can lead to different types of phenomena, including rocking of the vessel relative to the cabinet within which it is supported and hitting of the cabinet by the vessel, as will be described in further detail below. This leads to the generation of high loads and severe vibration of the vessel. Such severe vibration can cause movement of the appliance across the floor or other supporting surface.

As illustrated in an exemplary schematic vertical axis washing machine 100 of FIG. 1, the washing machine 100 typically comprises an imperforate tub 102 mounted within a cabinet 104 and a perforated wash basket 106 mounted within the tub 102 and rotatable relative to the tub 102. The wash basket 106 defines a wash chamber 108 that can receive a load of clothes to be subjected to various wash, rinse, and spin cycles, as is well-known in the washing machine art. A motor 110 operably coupled to the wash basket 106, an agitator 112 mounted in the wash basket 106, and a controller 116 rotates the wash basket 106 and/or the agitator 112 according to the wash, rinse, and spin cycles executed by the controller 116.

The tub 102 and the wash basket 106 are suspended within the cabinet 104 by a suspension system 114, which dampens some vibratory movement of the tub 102 and the wash basket 106. As a result of this suspended configuration, the suspended mass comprising the tub 102, the wash basket 106, and the clothes load in the wash basket 106, has six degrees of freedom; the suspended mass can translate along an x-axis (side-to-side movement), a y-axis (front-to-back movement), and a z-axis (up-and-down movement) and can rotate about the x-, y-, and z-axes, which are illustrated in FIG. 2.

During the spin cycles, the motor 110 increases the rotational speed of the wash basket 106 according to a spin profile, which can comprise various speed ramps and speed plateaus. As the speed increases, the suspended mass passes through natural frequencies corresponding to the six degrees of freedom. At these natural frequencies, the suspended mass has a natural tendency to move according to the corresponding degree of freedom, and this tendency is increased dramatically when the clothes load is off-balance. Thus, when the suspended mass passes through x-axis and y-axis translational natural frequencies, the suspended mass with an off-balance load can swing side-to-side and front-to-back, much like a pendulum, and hit the sides of the cabinet 104. Similarly, when the suspended mass passes through the z-axis translational natural frequency, the suspended mass with an off-balance load has a tendency to move up-and-down and thereby hit the top of the cabinet 104 and/or bottom out the suspension system 114. Finally, when the suspended mass passes through the rotational natural frequencies, the suspended mass with an off-balance load has a tendency to rock within the cabinet 104.

Various attempts have been provided in the prior art to provide mechanical arrangements, such as paddle switches, to detect the presence of an off-balance load by physically detecting when the vessel approaches or hits the cabinet. However, mechanical switches can be costly, are not robust to levelness, and might not distinguish between potentially acceptable light cabinet hitting and unacceptable heavy cabinet hitting. As gaps between the vessel and the cabinet of washing machines continue to decrease as vessel capacity increases, the ability to distinguish between light and heavy cabinet hits becomes more essential.

Approaches have also been disclosed in the prior art for detecting a load imbalance by monitoring variation of an output, such as motor current or voltage signal, of an operational component of the washing machine to eliminate mechanical switches and reduce cost. Often, the output is processed in some manner and then compared to a predetermined threshold for determining whether an imbalance is present. Depending on the output utilized, such methods are usually only suitable for particular speeds during a spin cycle and can be unreliable, even at the suitable speeds. Additionally, if the methods are suitable at spin speeds corresponding to only one or some of the translational or rotational natural frequencies, then off-balance loads that are not detected by or deemed acceptable by the method can potentially cause damage to the washing machine when they reach and pass through the other natural frequencies at higher spin speeds.

SUMMARY OF THE INVENTION

A method according to one embodiment of the invention for detecting an off-balance condition of a clothes load in a washing machine comprising a cabinet, within which is mounted a mass comprising a tub and a wash basket mounted within the tub and defining a wash chamber for receiving the clothes load, and a motor for rotating the wash basket about a rotational axis comprises receiving a multiple frequency speed signal representative of a rotational speed of the wash basket and extracting from the multiple frequency speed signal at least one frequency signal representative of an off-balance condition of the clothes load.

The off-balance condition can effect rocking of the wash basket. The frequency signal can have a frequency of about 1.0 $Rev^{-1}$.

The off-balance condition can effect top or bottom hits by the wash basket. The frequency signal can have a frequency of about 0.5 $Rev^{-1}$.

The off-balance condition can effect unstable hitting of the cabinet by the tub. The frequency signal can have a frequency of at least one of about ⅛ $Rev^{-1}$ and about ⅕ $Rev^{-1}$.

The extracting can comprise filtering the at least one frequency signal from a plurality of frequency signals that comprise the multiple frequency speed signal.

The at least one frequency signal can comprise two frequency signals representative of an off-balance condition of the clothes load, wherein each of the frequency signals corresponds to a different effect of the off-balance condition.

The method can further comprise determining the presence of an off-balance condition from the at least one frequency signal. The determining of the presence of the off-balance condition can comprise comparing the at least one frequency signal to an amplitude threshold. The determining of the presence of the off-balance condition can further comprise determining a residual from the comparison of the at least one frequency signal to the amplitude threshold and comparing the residual to a residual threshold. The comparing of the at least one frequency signal to the amplitude threshold can comprise calculating a difference between the amplitude threshold and the at least one frequency signal. The calculating of the difference can occur when the at least one frequency signal less than the amplitude threshold.

The speed signal can be a speed of the motor.

The receiving of the multiple frequency speed signal can comprise receiving the multiple frequency speed signal over a predetermined range of speed. The predetermined range of speed can comprise speeds corresponding to at least one of a translational natural frequency of the mass and a rotational natural frequency of the mass.

A method according to another embodiment of the invention for detecting an off-balance condition of a clothes load in a washing machine comprising a wash basket defining a wash chamber for receiving the clothes load and a motor for rotating the wash basket about a rotational axis comprises receiving a speed signal representative of a rotational speed of the wash basket, determining a measure of fluctuation in the speed signal, comparing the measure to a predetermined measure threshold, adding the measure to a residual if the measure exceeds the predetermined measure threshold, and comparing the residual to a predetermined residual threshold to determine whether an off-balance condition is present.

The determining of the measure can comprise calculating a difference between the speed signal and a reference. The reference can be an average of the speed signal. The speed signal can comprise a plurality of speed samples, and the average can be taken over a window comprising at least two of the plurality of speed samples. The calculating of the difference can comprise calculating a difference between one of the plurality of speed samples in the window and the average. The window can comprise an odd number of the speed samples, and the one of the plurality of speed samples can be a middle speed sample in the window.

The receiving of the speed signal can comprise receiving the speed signal over a predetermined range of speed. The predetermined range of speed can comprise speeds corresponding to at least one translational natural frequency of the wash basket.

The speed signal can be a speed of the motor.

A method according to another embodiment of the invention for detecting an off-balance condition of a clothes load in a washing machine comprising a wash basket defining a wash chamber for receiving the clothes load and a motor for rotating the wash basket about a rotational axis comprises receiving a speed signal comprising speed samples representative of a rotational speed of the wash basket, defining a window comprising at least two speed samples, determining an average of the speed samples in the window, determining a difference between one of the speed samples in the window and the average, and comparing the difference to a predetermined difference threshold.

The method can further comprise adding the difference to a residual if the difference exceeds the predetermined difference threshold and comparing the residual to a predetermined residual threshold to determine whether an off-balance condition is present.

The window can comprise an odd number of the speed samples, and the one of the speed samples can be a middle speed sample in the window.

The method can further comprise shifting the window a predetermined number of speed samples and determining a new average and a new difference. The predetermined number of speed samples can be one speed sample.

The receiving of the speed signal can comprise receiving the speed signal over a predetermined range of speed. The predetermined range of speed can comprise speeds corresponding to at least one translational natural frequency of the wash basket and the clothes load in the wash basket. The predetermined range of speed can comprise speeds between about 60 rpm and about 120 rpm.

The speed signal can be a speed of the motor.

A method according to another embodiment of the invention for detecting an off-balance condition of a clothes load in a washing machine comprising a wash basket defining a wash chamber for receiving the clothes load and a motor for rotating the wash basket about a rotational axis comprises executing a first off-balance detection scheme during a first range of wash basket rotation speed and executing a second off-balance detection scheme, different than the first off-balance detection scheme, during a second range of wash basket rotation speed different than the first range of wash basket rotation speed.

According to one embodiment, the first range and the second range do not overlap.

The method can further comprise executing a third off-balance detection scheme, different than the first and second off-balance detection schemes, during a third range of wash basket rotation speed different than the first and second ranges of wash basket rotation speed.

The first off-balance detection scheme can comprise receiving a speed signal comprising speed samples representative of a rotational speed of the wash basket, defining a window comprising at least two speed samples, determining an average of the speed samples in the window, determining a difference between one of the speed samples in the window and the average, comparing the difference to a predetermined difference threshold, adding the difference to a residual if the difference exceeds the predetermined difference threshold, and comparing the residual to a predetermined residual threshold to determine whether an off-balance condition is present.

The second off-balance detection scheme can comprise receiving a multiple frequency speed signal representative of a rotational speed of the wash basket and extracting frequency signals having a frequency of about 0.5 $Rev^{-1}$ and about 1.0 $Rev^{-1}$ from the multiple frequency speed signal.

The third off-balance detection scheme can comprise receiving a multiple frequency speed signal representative of a rotational speed of the wash basket, and extracting a frequency signal having a frequency of about ⅛ $Rev^{-1}$ from the multiple frequency speed signal.

The first range can comprise speeds corresponding to X-axis and Y-axis translational natural frequencies of the wash basket. The second range can comprise speeds corresponding to a Z-axis translational natural frequency and at least one rotational natural frequency of the wash basket.

A method according to another embodiment of the invention for controlling a spin speed of a wash basket driven by a motor in a washing machine comprises detecting a line voltage from a power line that provides a voltage supply for the motor and limiting a maximum torque output of the motor based on the line voltage.

The detecting of the line voltage can comprise measuring a DC rail voltage for the motor. The measuring of the DC rail voltage can comprise measuring the DC rail voltage for the motor at a constant spin speed of the wash basket. The limiting of the maximum torque output can occur at spin speeds greater than the constant speed.

The limiting of the maximum torque output can comprise setting a maximum advance angle for the motor. The maximum advance angle for the motor can be set between about 80 and 85 degrees.

BRIEF DESCRIPTION OF THE DRAWINGS

In the drawings:

FIG. 15 is a table of exemplary maximum advance angles for ranges of HVDC for the power limiting method.

DESCRIPTION OF THE EMBODIMENTS OF THE INVENTION

An off-balance detection method 10 according to one embodiment of the invention addresses the deficiencies of the prior art and provides a method for detecting an unbalanced load over an entire speed range of a spin cycle without the need for additional sensors. The method 10 can be utilized with any suitable washing machine, such as the washing machine 100 described in the background of the invention, any other vertical axis washing machine, and any horizontal axis washing machine.

Figure 1:
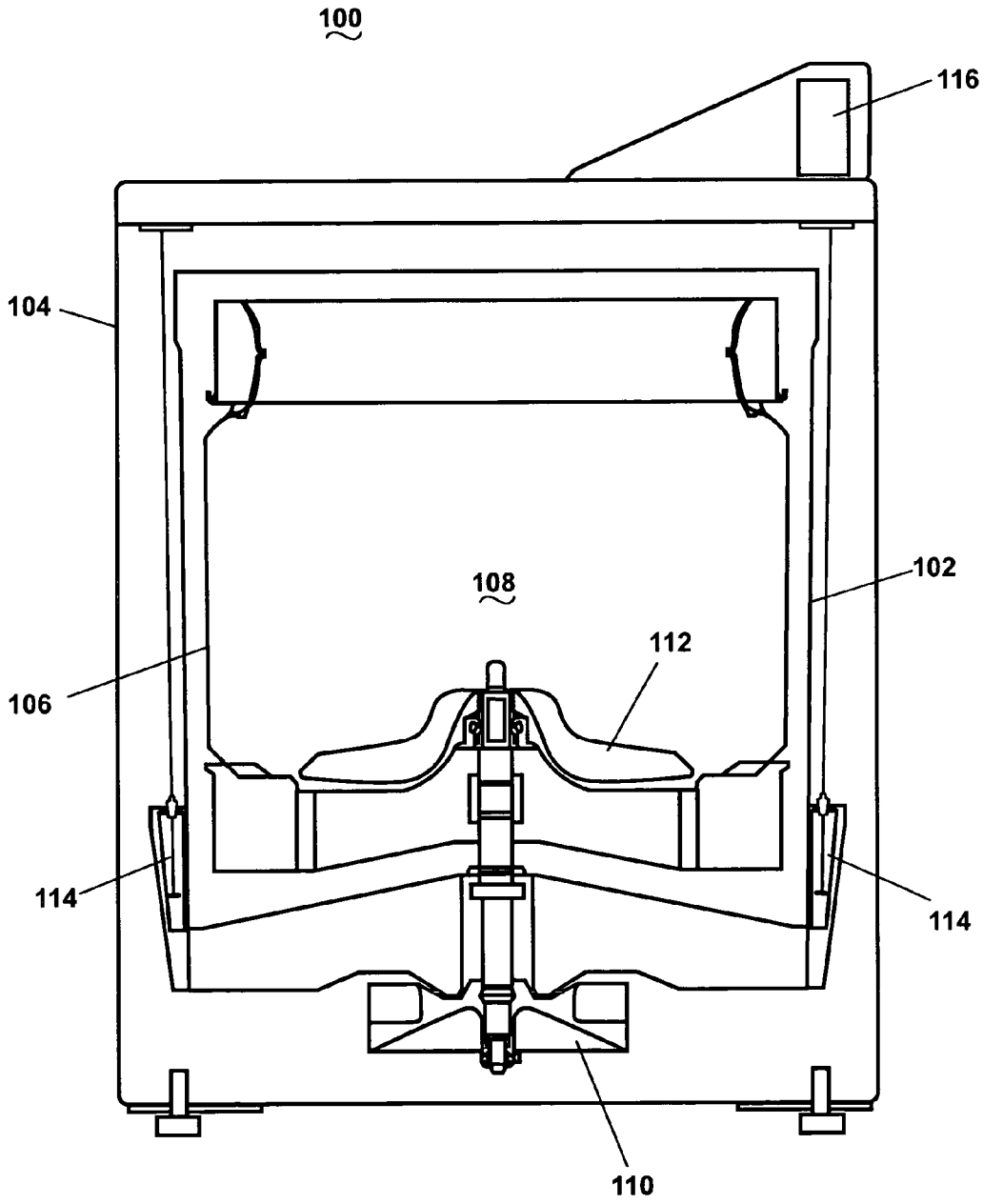
FIG. 1 is a schematic side view of an exemplary washing machine comprising a tub and a wash basket supported by a suspension system.
Figure 2:
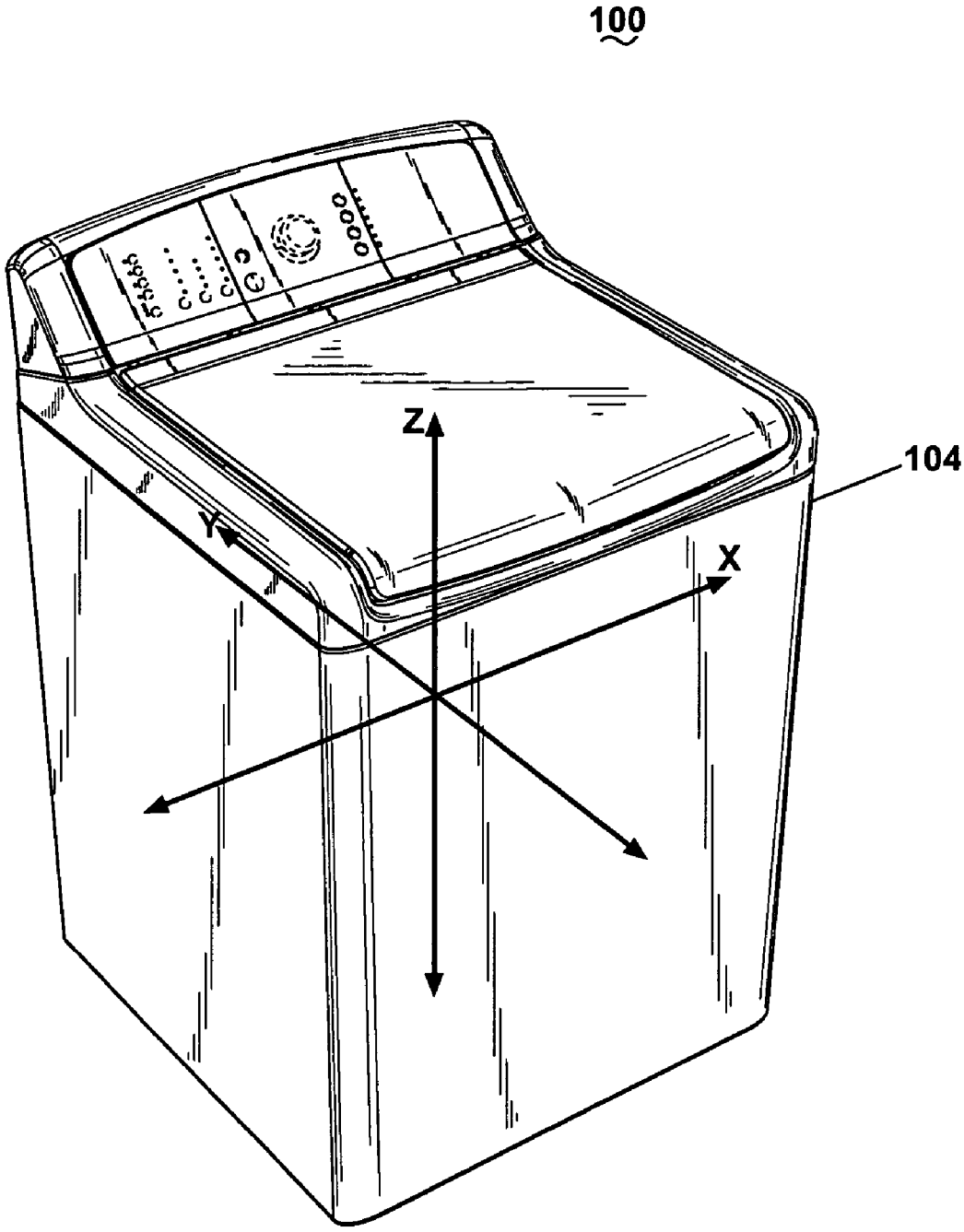
FIG. 2 is a perspective view of an exemplary washing machine illustrating an x-axis, a y-axis, and a z-axis used to define degrees of freedom for the tub and wash basket shown in FIG. 1.
Figure 3:
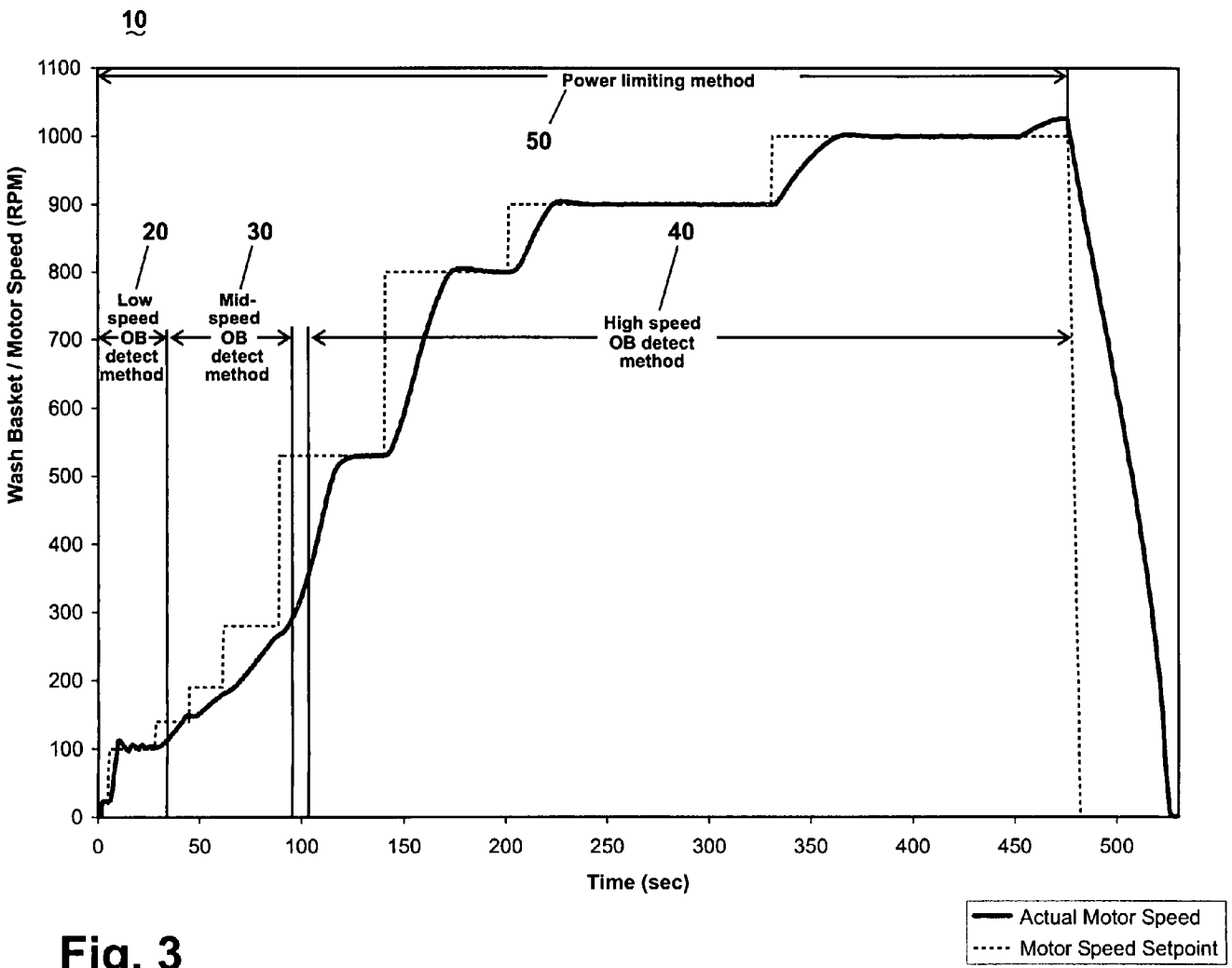
FIG. 3 is a graph illustrating an exemplary speed profile of a spin cycle in a washing machine and exemplary speed ranges during which low, mid-, and high speed off-balance detection methods and a power limiting method of an off-balance detection method according to one embodiment of the invention are active.

The method 10 comprises several individual methods or schemes, each applicable at a different speed ranges, which correspond to the translational and rotational natural frequencies of the mass comprising the tub 102, the wash basket 106, and the load in the wash basket 106, and the individual methods of the method 10 are particularly suited for detecting off-balance loads as they pass through particular translational and rotational natural frequencies. According to one embodiment of the invention, the method 10 comprises a low speed off-balance (OB) detection method 20, a mid-speed off-balance detection method 30, and a high speed off-balance detection method 40. The low, mid-, and high speed descriptors for corresponding methods 20, 30, and 40 are utilized herein to differentiate the methods 20, 30, 40 from one another. In practice, the methods 20, 30, 40 are especially suitable, according to one embodiment of the invention, for particular natural frequencies of the mass, and the speed ranges during which the methods 20, 30, and 40 are employed include the speeds that correspond to the particular natural frequencies, which can vary from one washing machine to another. Additionally, the method 10 can incorporate a power limiting method 50 that can be employed at any speed during the spin cycle. FIG. 1 illustrates an exemplary speed profile during a spin cycle and exemplary speed ranges over which the methods 20, 30, 40, 50 are employed. Each of these methods is described in detail below.

The low speed off-balance detection method 20, the mid-speed off-balance detection method 30, and the high speed off-balance detection method 40, according to one embodiment of the invention, utilize the speed of the motor 110 that drives the wash basket 106 to determine the presence of an off-balance load. The motor speed corresponds to the speed of the wash basket 106 and can be measured in any suitable manner. For example, the motor speed can be measured directly via rotor position sensors of the motor 110. While any suitable speed sensor can be used, when the rotor position sensors are Hall Effect sensors utilized, Hall jitter errors can be filtered to obtain a meaningful signal without noise. For a motor 110 having one hundred forty-four commutations per revolution, optimum filter sizes were found to be eighteen or thirty-six commutations, which provide eight or four data points per revolution, respectively. These filter sizes minimize Hall jitter errors because a main source of the error is variation in a gap between physical magnet arcs on the rotor of the motor 110. Each magnet arc contains three magnetic flux changes, and there are three phases; therefore, there are nine commutations on each magnet arc. By averaging over an integer multiple of the magnet arcs, or, in this case, pairs of magnet arcs, the error from the gaps between the magnet arcs in minimized. For a "worst-case" rotor with an individual commutation time jitter of +/−25%, averaging over eighteen commutations was found to reduce the error to about 0.5%, and using thirty-six commutations was found to reduce the error to 0.2%.

As an alternative to filtering, the commutation time jitter can be canceled by creating a reference map of the commutation time errors during a constant speed where there is no imbalance in the clothes load. At higher speeds, instantaneous errors can be subtracted from the reference map to obtain an accurate measure of speed variation, which is indicative of an off-balance load. While the canceling method can provide an accurate speed variation measurement at high speeds, it requires a steady-state speed condition to create the reference map.

By measuring motor speed variations instead of, for example, current or power, the methods 20, 30, 40 are robust to machine variations, such as motor magnet strength or controller component variation. The methods 20, 30, 40 are also decidedly robust to environmental variations, such as line voltage, when using motor speed. Additionally, at high spin speeds, the motor 110 can already be at its maximum current limit, which means that current cannot increase under an unstable condition and, as a result, is not a suitable indicator of off-balance loads. In these situations, it is therefore desirable to use the motor speed for off-balance detection. However, it is within the scope of the invention for the methods 20, 30, 40 to utilize outputs other than motor speed, as is well-known in the washing machine art.

A description of the low speed off-balance detection method 20 follows. When the wash basket 106 has an off-balance load, the tub 102 and the wash basket 106, due to being mounted within the tub 102, can strike the sides of the cabinet 104, especially while passing through the x-axis and y-axis translational natural frequencies of the mass. Thus, cabinet hits can be viewed as an effect of rotating the wash basket 106 with an off-balance load at speeds corresponding to the x-axis and y-axis translational natural frequencies, which can vary from one washing machine to another and have been determined to be between about 40-60 rpm for some washing machines. The cabinet hits result in a loss of kinetic energy from the spinning wash basket 106 and correspond to a drop in the speed of the wash basket 106. As the controller 116 tries to regulate the speed of the wash basket 106, the off-balance loads and the cabinet hits can be seen as oscillations in the motor speed.

The low speed off-balance detection method 20 is active during a speed range that includes the speeds corresponding to the x-axis and y-axis translational natural frequencies of the mass. An exemplary speed range for the low speed off-balance detection method 20 is a low speed range at the beginning of the spin cycle, such as from about 60 rpm to about 120 rpm. The method 20 is especially suitable for this speed range as it is notably robust to quick accelerations that commonly occur at the beginning of spin cycles. The controller 116 receives speed samples at a predetermined rate, such as eight speed samples per revolution. For a motor having one hundred forty-four commutations per revolution, the sampling rate of eight motor speed samples per revolution is calculated by measuring time required for the rotor position sensors to detect eighteen consecutive position changes or commutations.

The controller 116 then determines a measure of fluctuation or variation of the speed signal. Once the measure is determined, the controller 116 compares the measure to a predetermined measure threshold. If the measure exceeds the predetermined measure threshold, then the measure is added to a residual, which is a running total of the measures that exceed the predetermined measure threshold. The residual is compared to a predetermined residual threshold to determine whether an off-balance condition is present. If the residual reaches or exceeds the predetermined residual threshold, then the load is determined to be off-balance. If the residual does not reach or exceed the predetermined residual threshold, then the method 20 continues while the spin cycle proceeds.

Figure 4:
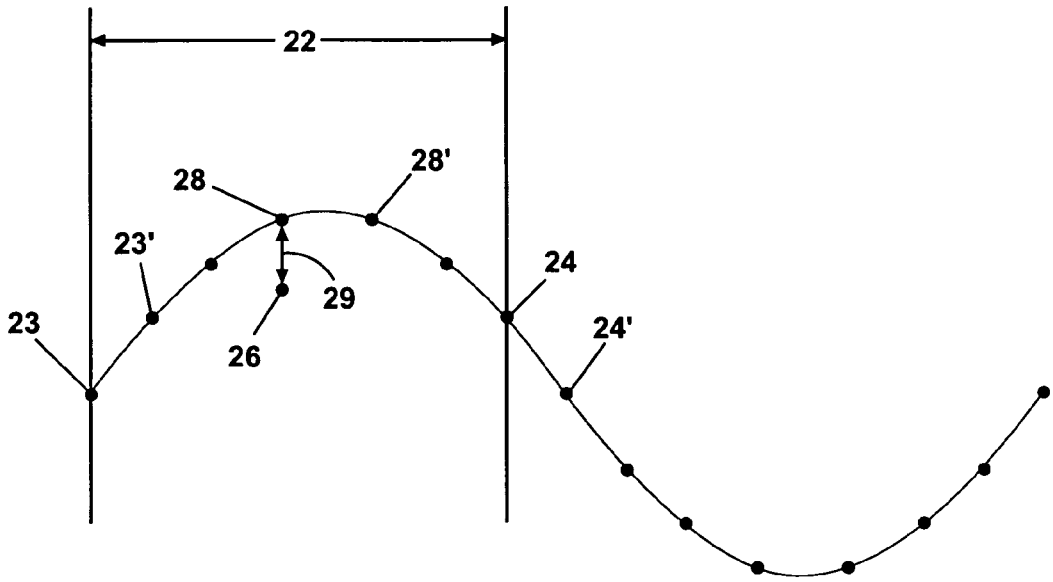
FIG. 4 is a schematic illustration of determining a measure of fluctuation of speed for the low speed off-balance detection method.

As an example of the measure of the fluctuation in the speed signal, the controller 116 can calculate a difference between the speed signal and a reference. The reference can be a fixed value or can be a varying quantity that changes according to the behavior of the speed signal. For example, the reference can be a speed average, such as an average over a moving average window having a predetermined number of speed samples, and the difference can be between the moving average and one of the speed samples in the moving average window. According to one embodiment, the moving average window has an odd number of speed samples so that the speed sample utilized to calculate the difference is located at the center of the moving average window. For example, with a seven sample moving average window 22 defined between a first speed sample 23 and a last speed sample 24, as illustrated schematically in FIG. 4, the motor speed signal, which is shown as a solid line in FIG. 4, is averaged over seven speed samples to calculate an average 26. The average 26 is compared to a center or fourth speed sample 28 in the moving average window to calculate the difference, which is depicted by an arrow 29 in FIG. 4. With a nine sample moving average window, the motor speed signal is averaged over nine speed samples, and the average is compared to a fifth speed sample in the moving average window to calculate the difference. It has been determined that the seven or nine sample moving average window is desirable, but the method 20 can sense the off-balance a quarter revolution sooner and is less computationally intensive with the seven sample moving average window as compared to the nine sample moving average window.

If the difference between the average and the one of the speed samples in the moving average window is larger than a predetermined Difference Threshold (i.e., measure threshold), then the controller 116 adds the difference to an Accumulated Difference residual. If the Accumulated Difference exceeds a predetermined Accumulated Difference Threshold (i.e., residual threshold), the load is considered off-balance, and the motor 110 stops. An off-balance recovery method 60, which is described in more detail below, can then be initiated. If the Accumulated Difference does not reach or exceed the predetermined Accumulated Difference Threshold, then the moving average window shifts by a predetermined number of the speed samples, a new average is calculated for the shifted moving average window, and a new difference is determined for the shifted moving average window. According to one embodiment, the moving average window shifts by one speed sample. The example of FIG. 4 illustrates a new first speed sample 23', a new last speed sample 24', and a new center speed sample 28' for the shifted moving average window that has been shifted by one speed sample.

The predetermined measure and residual thresholds, such as the Difference Threshold and the Accumulated Difference Threshold, respectively, can be determined empirically and can differ for different washing machines. The predetermined measure and residual thresholds can be selected to set a desired off-balance sensitivity level, which determines which loads are sufficiently unbalanced to be deemed off-balance by the method 20 and which off-balance loads are minor enough to be allowed to pass. As an example, the Difference Threshold can be about 80-85-rpm, and the Accumulated Difference Threshold can be about 250 rpm.

Figure 5:
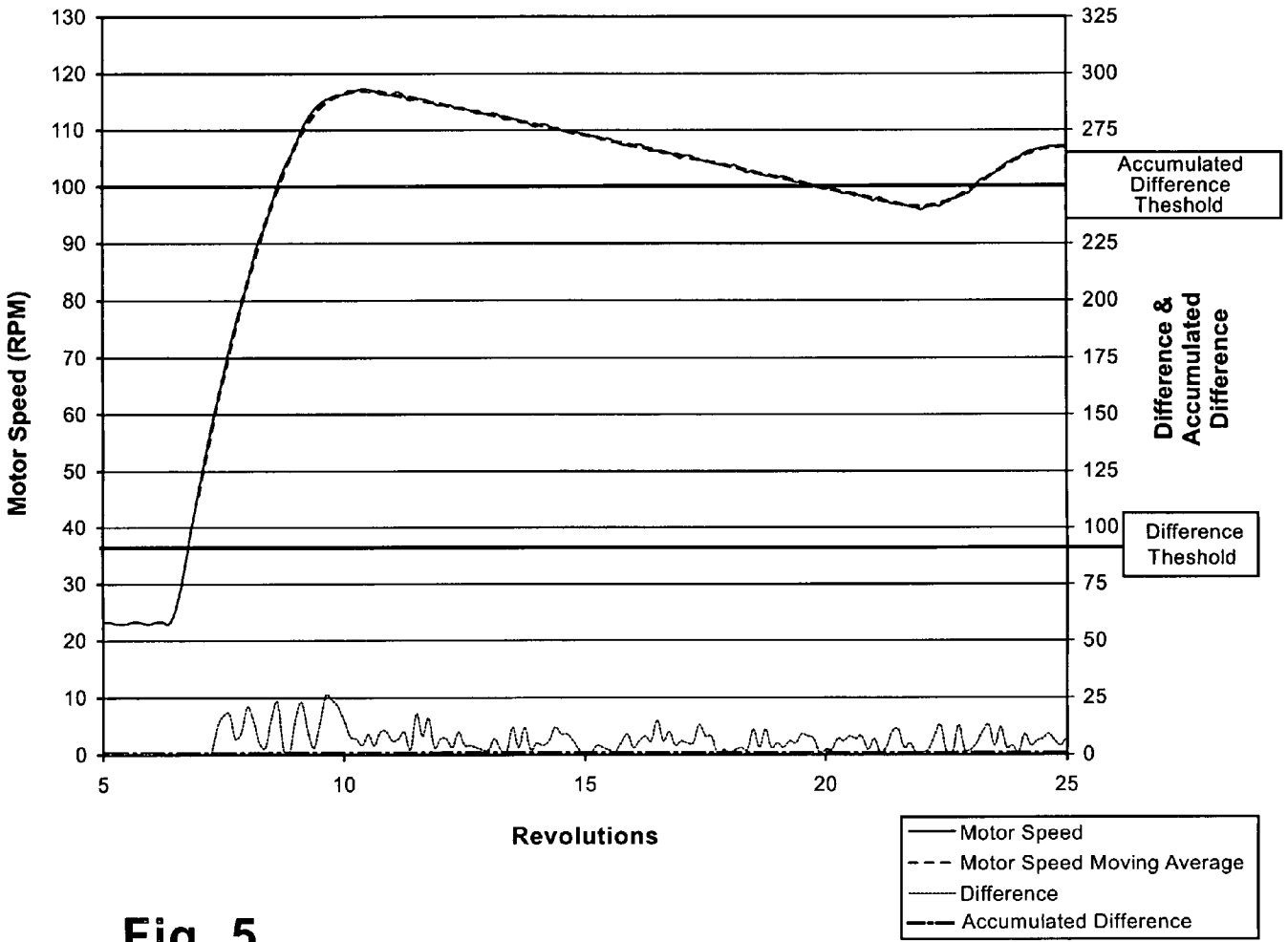
FIG. 5 is a graph illustrating an exemplary speed profile of a portion of a spin cycle during which the low speed off-balance detection method is active and the load is balanced.
Figure 6:
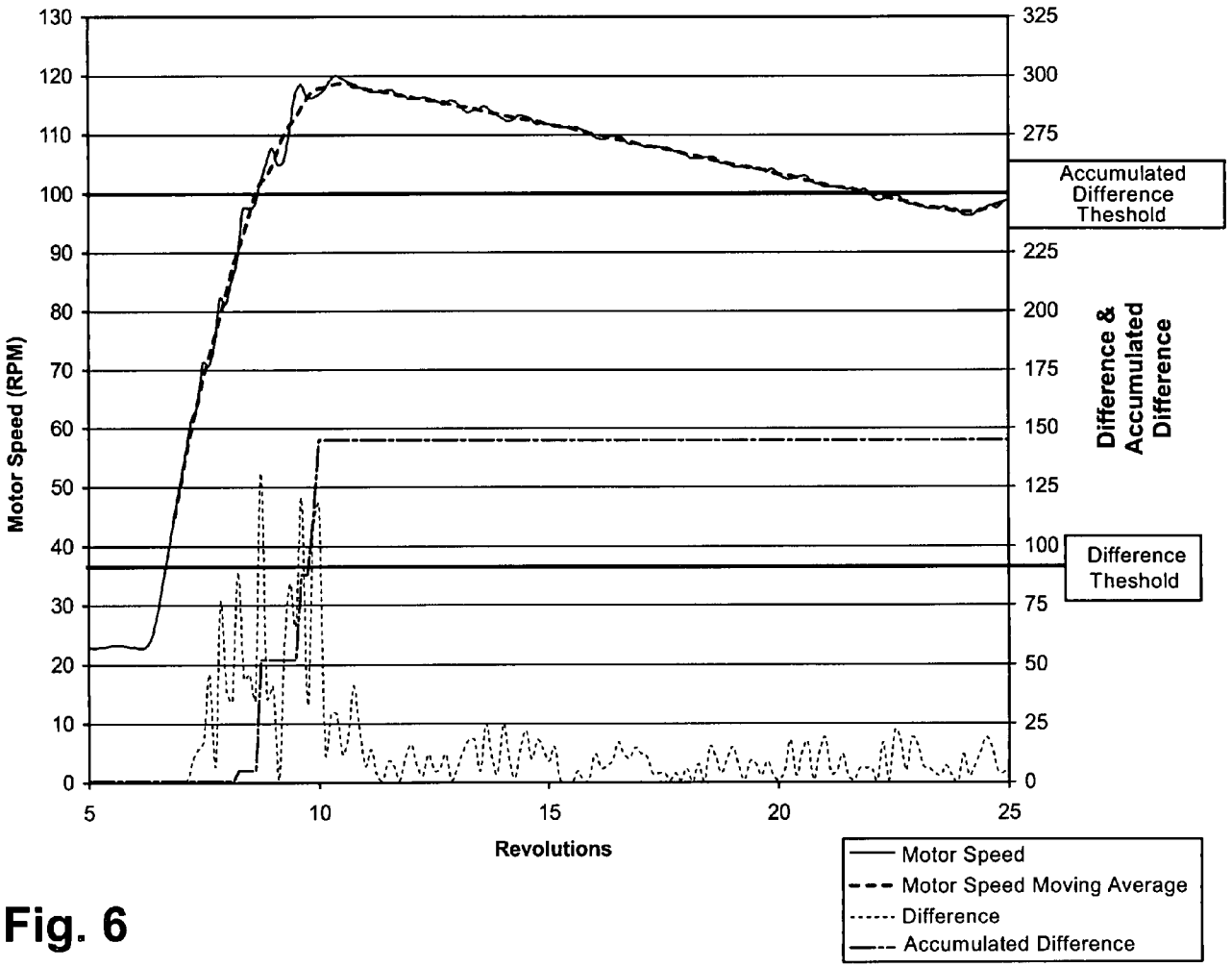
FIG. 6 is a graph illustrating an exemplary speed profile of a portion of a spin cycle during which the low speed off-balance detection method is active and the load has a small imbalance.
Figure 7:
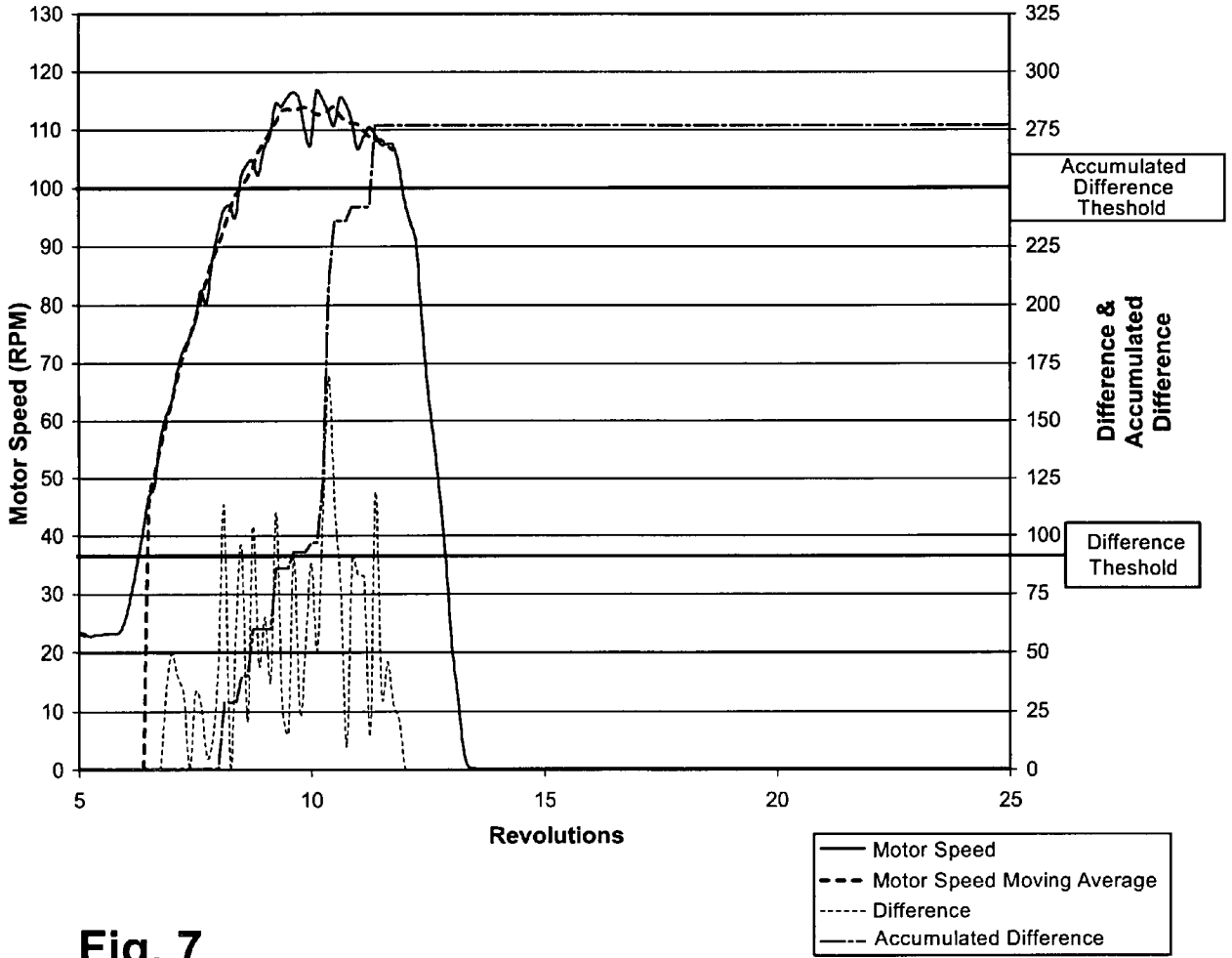
FIG. 7 is a graph illustrating an exemplary speed profile of a portion of a spin cycle during which the low speed off-balance detection method is active and the load has a large imbalance.

Exemplary speed profiles for a spin cycle employing the low speed off-balance detection method 20 are illustrated in FIGS. 5-7. FIG. 5 shows a motor speed profile for a 12 kg distributed load with no off-balance. The speed signal is notably smooth, and the difference never reaches the Difference Threshold. Thus, the Accumulated Difference never reaches the Accumulated Difference Threshold. FIG. 6 shows a speed profile for a 12 kg distributed load with a 2.5 kg off-balance load that lightly hits the cabinet 104 such that some of the differences are large enough to be added to the Accumulated Difference but is not strong enough for the Accumulated Difference to exceed the Accumulated Difference Threshold. However, a 12 kg distributed load with a 5-kg off-balance load strikes the cabinet 104 with greater force, thereby resulting in larger differences or speed deviations, as shown in FIG. 7. In this case, the Accumulated Difference exceeds the Accumulated Difference Threshold, and the machine is shut down.

When the motor 110 stops, the off-balance recovery method 60 begins. The off-balance recovery method 60 described herein is for exemplary purposes only, and any suitable recovery method can be utilized with the method 10. First, the controller 116 begins to execute the spin cycle again. If the load is determined to be out of balance a second time, the controller 116 fills the wash basket 106 and agitates to attempt to redistribute the load. Following redistribution, the spin cycle is run again. If the load is determined to be out of balance a third time, then the controller 116 stops the motor 110 and then begins to execute the spin cycle again. Finally, if the load is determined to be out of balance a fourth time, then the cycle is paused, and the controller 116 signals to the user through a visual or audio signal, for example, that the load is unbalanced and requires user intervention to redistribute the load.

While a majority of severely off-balance loads are detected by the low speed off-balance detection method 20, some off-balance loads are able to pass through the low speed range that includes the speeds corresponding to x-axis and y-axis translational natural frequencies of the mass. As the spin speed increases beyond the low speed range, such off-balance loads pass through the z-axis translational natural frequency and the rotational natural frequencies, which can lead to the tub 102 hitting the top of the cabinet 104 and bottoming out the suspension system 114 (i.e., top and bottom hits) or rocking of the tub 102, respectively. Thus, top and bottom hits and rocking can be viewed as effects of rotating the wash basket 106 with an off-balance load at speeds corresponding to the z-axis translational natural frequency and the rotational natural frequencies, respectively, which can vary from one washing machine to another and have been determined to be between about 120-220 rpm for some washing machines. By monitoring the speed of the wash basket 106 through a speed range that includes the speeds corresponding to the z-axis translational natural frequency and the rotational natural frequencies, the controller 116 can differentiate a balanced load from an off-balance load that is causing top and bottom hits and rocking phenomena. Thus, the mid-speed off-balance detection method 30 is active during a speed range that includes the speeds corresponding to the z-axis translational natural frequency and the rotational natural frequencies. An exemplary speed range for the mid-speed off-balance detection method 30 is a mid-speed range, such as from about 120 rpm to about 290 rpm, following the low speed range.

Figure 8:
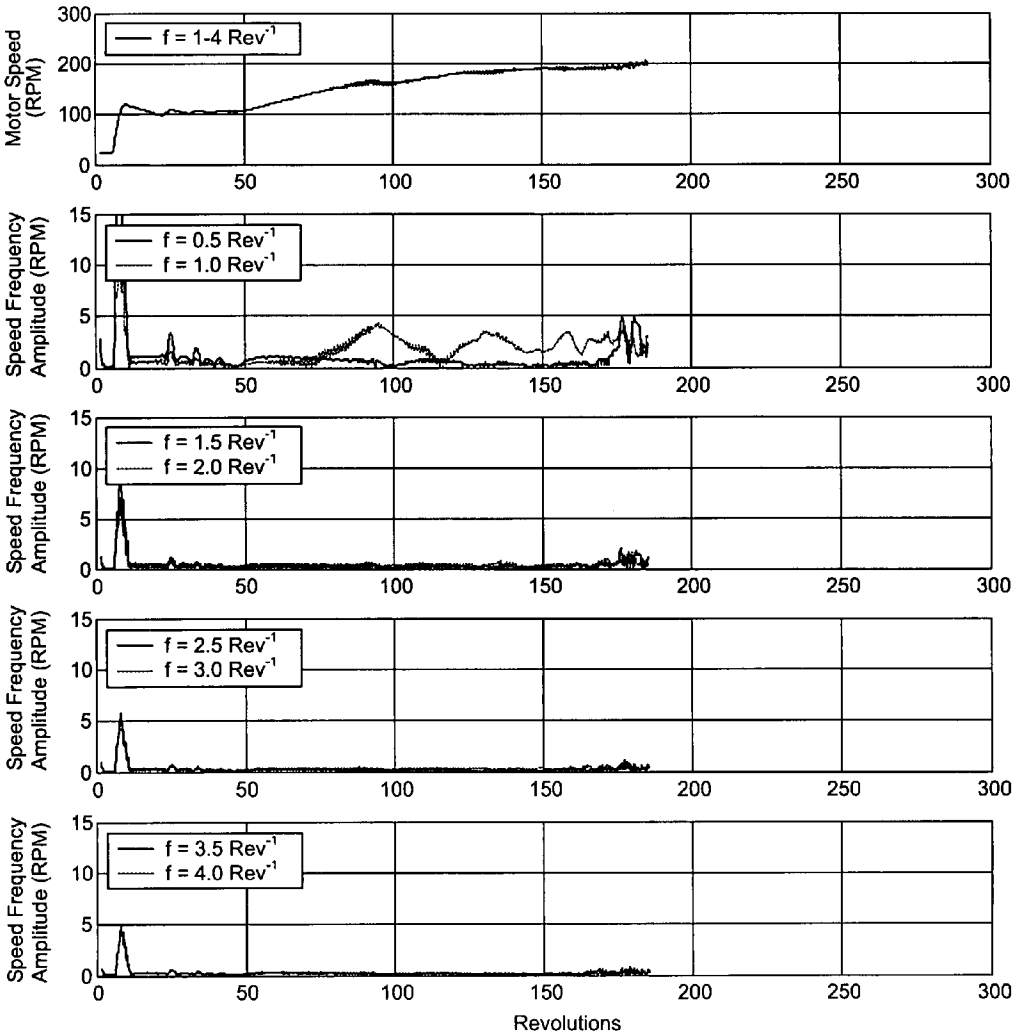
FIG. 8 is a series of graphs illustrating motor speed and corresponding amplitude outputs of a Fast Fourier Transform of the motor speed for an off-balance load at a portion of the spin cycle during which the mid-speed off-balance detection method is active.
Figure 9:
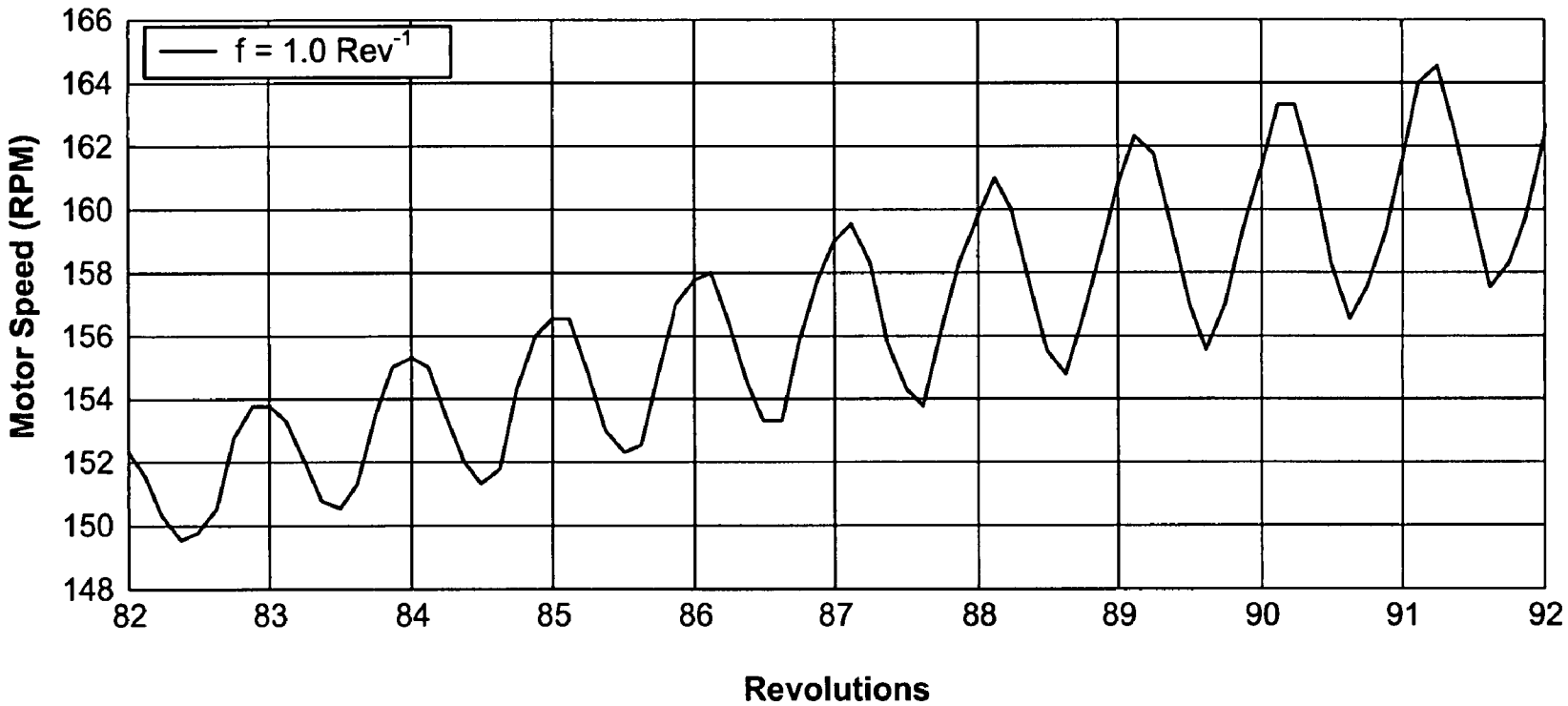
FIG. 9 is an enlarged view of a portion of the motor speed for the frequency of $f=1.0\ Rev^{-1}$ shown in FIG. 8.
Figure 10:
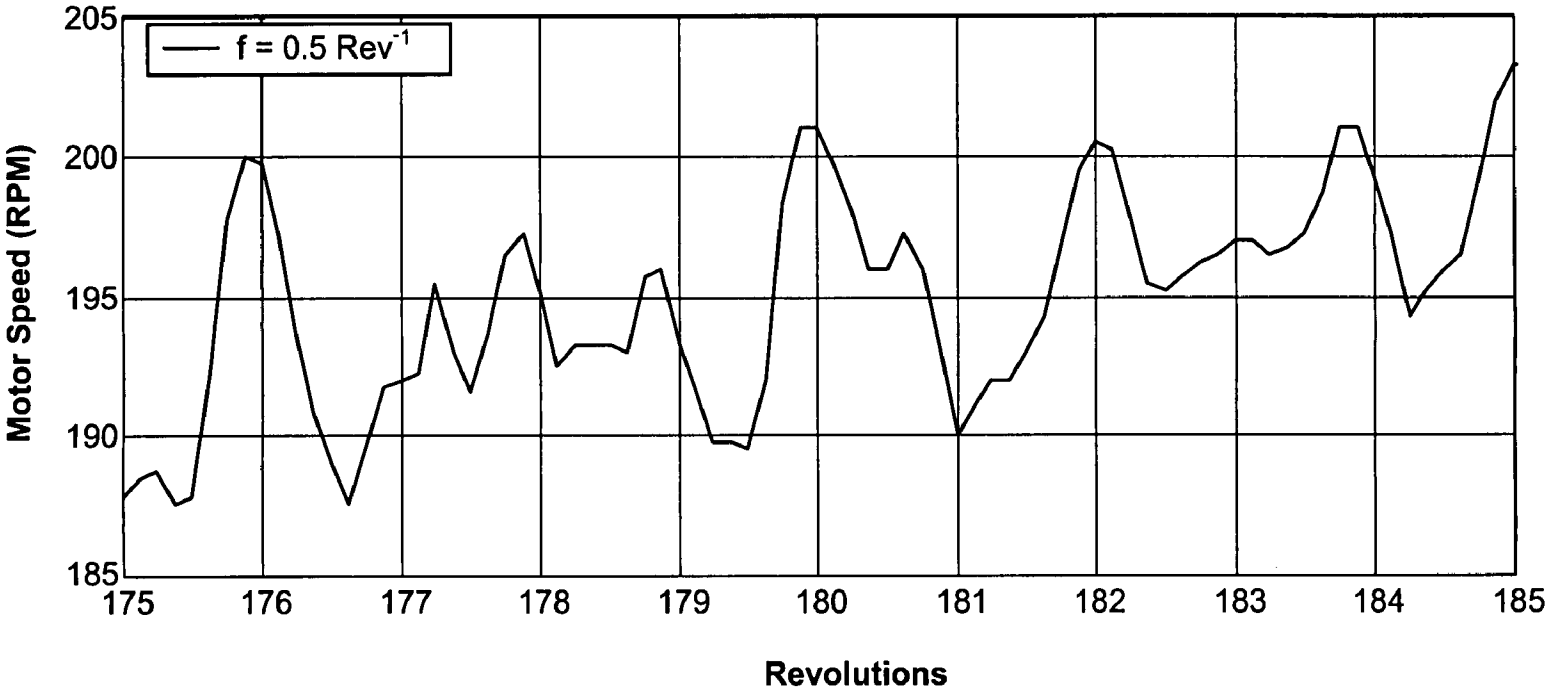
FIG. 10 is an enlarged view of a portion of the motor speed for the frequency of $f=0.5\ Rev^{-1}$ shown in FIG. 8.

The speed signal utilized by the method 30 is a multiple frequency speed signal comprising a plurality of individual frequency signals. FIG. 8 depicts an exemplary composite multiple frequency speed signal for a spin cycle run with 12 kg distributed load and 2.5 kg of off-balance load placed low in the wash basket 106. Corresponding amplitude outputs of a Fast Fourier Transform of the speed signal are plotted for a frequency set f=[0.5, 1.0, 1.5, 2.0, 2.5, 3.0, 3.5, 4.0] $Rev^{-1}$. After an initial ramping transient occurs at the beginning of the spin cycle, the amplitude of f=1.0 $Rev^{-1}$ increases as the motor 110 approaches about one hundred revolutions, and the amplitude of f=0.5 $Rev^{-1}$ does not show a significant variation until about one hundred seventy revolutions. All of the other frequencies have relatively small amplitudes throughout the spin cycle. It was discovered that the amplitude of frequency f=1.0 $Rev^{-1}$ correlates very well to the rocking phenomenon, while the amplitude of f=0.5 $Rev^{-1}$ is a strong indicator of the top and bottom hits. FIGS. 9 and 10 show the dominance of the frequencies f=1.0 $Rev^{-1}$ and f=0.5 $Rev^{-1}$, respectively, in more detail.

The mid-speed off-balance detection method 30 extracts one or more of the individual frequency signals from the multiple frequency speed signal and utilizes the one or more of the individual frequency signals to detect whether an off-balance condition is present. According to one embodiment, the mid-speed off-balance detection method 30 employs one or more filters to analyze the multiple frequency speed signal and to filter the individual frequency signals that are useful for detecting the top and bottom hits and rocking phenomena.

The multiple frequency motor speed signal can be separated into the individual frequency signals by digital filtering. Narrow-band filters can be designed to isolate one frequency from another, but real-math multiplication is usually required for recursion coefficients, thereby making implementation on a microcontroller prohibitive. However, it is possible to arbitrarily eliminate a chosen set of frequencies (to by placing filter zeros $z_i$ in the z-plane according to the relationship $$z_i = e^{\pm j\omega_i T_s}$$

where $T_s$=is the delay between samples (e.g., ⅛ Rev). A corresponding filter transfer function F(z) can be obtained by $$F(z) = \prod_i (1 - z_i z^{-1})$$

In order to let frequency f1=0.5 $Rev^{-1}$ pass, a first filter $F_{0.5}(z)$ is designed such that frequencies f=[0.0, 1.0, 2.0, 3.0, 4.0] $Rev^{-1}$ are completely rejected, and a low-pass filter is used to further attenuate frequencies f>f1. Similarly, a second filter $F_{1.0}(z)$ for f2=1.0 $Rev^{-1}$ is designed such that frequencies f=[0.5, 1.5, 2.5, 3.5] $Rev^{-1}$ are completely rejected, and a band-pass filter is cascaded to attenuate frequencies f≠1.0 $Rev^{-1}$. Locations of zeros and poles of the designed filters are specifically chosen with an additional constraint that the recursion coefficients can be represented as binary numbers for easier implementation.

When the method 30 is executed, the controller 116 receives speed samples of the multiple frequency speed signal at a predetermined rate, such as eight speed samples per revolution. For a motor having one hundred forty-four commutations per revolution, the sampling rate of eight motor speed samples per revolution is calculated by measuring time required for the rotor position sensors to detect eighteen consecutive position changes or commutations. The controller 116 then extracts one or more of the individual frequency signals from the multiple frequency speed signal. Once the individual frequency signal is extracted, the controller 116 compares the amplitude of the individual frequency signal to a predetermined amplitude threshold. If the amplitude of the individual frequency signal at a given time exceeds the predetermined amplitude threshold, then a difference between the individual frequency signal at the given time and the predetermined amplitude threshold is added to a residual, which is a running total of the differences. The residual is compared to a predetermined residual threshold to determine whether an off-balance condition is present. If the residual reaches or exceeds the predetermined residual threshold, then the load is determined to be off-balance. If the residual does not reach or exceed the predetermined residual threshold, then the spin cycle continues while the method 30 continues.

Figure 11:
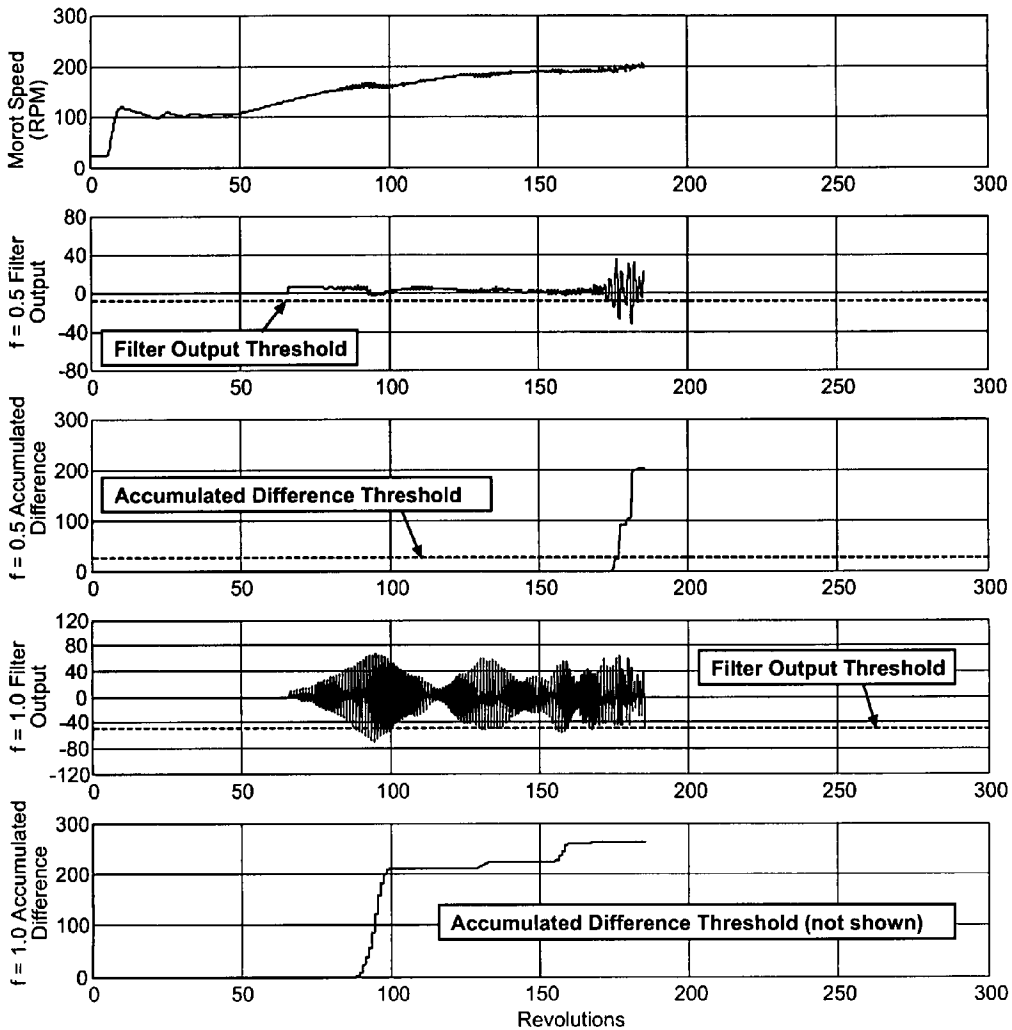
FIG. 11 is a series of graphs showing an exemplary implementation of the mid-speed off-balance detection method utilizing the $f=0.5\ Rev^{-1}$ and the $f=1.0\ Rev^{-1}$ signals shown in FIG. 8.

For example, the speed samples can pass through the first and second filters $F_{0.5}(z)$ and $F_{1.0}(z)$ to extract filtered output signals, such as the exemplary output signals shown in FIG. 11, corresponding to the frequencies f=0.5 $Rev^{-1}$ and f=1.0 $Rev^{-1}$, respectively, to detect out of balance loads that are causing top and bottom hits and rocking, respectively. In FIG. 11, filter calculations were enabled for motor speeds greater than 125 rpm. The remaining description of this example refers to one of the filtered output signals, with it being understood that the same process can apply to both of the filtered output signals. The filtered output signal is compared to a predetermined Filter Output Threshold (i.e., the amplitude threshold). According to the embodiment shown in FIG. 11, the predetermined Filter Output Threshold is a negative value, and if the filtered output signal is less than the Filter Output Threshold, then an absolute value of a difference between the predetermined Filter Output Threshold and the filtered output signal is determined. By taking the difference in this manner, undesired transient frequency components generated during positive speed accelerations are not taken into account.

The absolute value of the difference is added to an Accumulated Difference residual, and if the Accumulated Difference reaches or exceeds a predetermined Accumulated Difference Threshold (i.e., the residual threshold), the load is determined to be off-balance. When more than one filtered output signal is utilized, the load can be determined to be off-balance when either one of the Accumulated Differences reaches or exceeds its corresponding Accumulated Difference Threshold or when both of the Accumulated Differences reach or exceed their corresponding Accumulated Difference Thresholds. At this point, the washing machine 100 can be stopped before initiation of the off-balance recovery method 60 or other suitable recovery method. In the examples of FIG. 11, the Accumulated Difference for the f=0.5 $Rev^{-1}$ signal exceeds the corresponding Accumulated Difference Threshold at about one hundred seventy-five revolutions, but the washing machine 100 was allowed to spin past the time at which the off-balance condition was detected. The Accumulated Difference for the f=1.0 $Rev^{-1}$ signal does not exceed the corresponding Accumulated Difference Threshold, which is greater than the maximum value shown on the y-axis of the corresponding graph in FIG. 11.

The predetermined amplitude and residual thresholds, such as the Filter Output Thresholds and the Accumulated Difference Thresholds, for the mid-speed off-balance detection method 30 can be determined empirically and can differ for different washing machines. Similar to the method 20, the predetermined amplitude and residual thresholds can be selected to set a desired off-balance sensitivity level. As an example, the Filter Output Threshold for the f=0.5 $Rev^{-1}$ and the f=1.0 $Rev^{-1}$ signals can be in the ranges of about −5 to −10 rpm and from about −45 to about −50, respectively. Exemplary values for the Accumulated Difference Thresholds for the f=0.5 $Rev^{-1}$ and the f=1.0 $Rev^{-1}$ signals are about 20 and about 1500 rpm, respectively.

Sometimes, the washing machine 100 is designed to allow moderately off-balance loads to spin to relatively high spin speeds. However, under some circumstances, such as when the washing machine 100 is not level, some off-balance loads can cause the wash tub 102 to unstably strike the cabinet 104 at speeds above which the low speed off-balance detection method 20 and the mid-speed off-balance detection method 30 are active. The mass can start to bounce off one side of the cabinet 104 and hit the opposing side of the cabinet 104, thereby causing the mass to start bouncing off two or more sides of the cabinet 104. Also, it is possible that the clothes load can shift during the spin cycle. For example, a bunched towel or shoes can flip from the bottom of the wash basket 106 to the top of the wash basket 106. If this occurs after the speed of the motor 110 and the wash basket 106 is outside the ranges of the low speed off-balance detection method 20 and the mid-speed off-balance detection method 30, it could cause excessive cabinet hitting if not detected. These situations, however, can be detected by the high speed off-balance detection method 40, which is active at speeds where unstable cabinet hitting can occur, such as a high speed range greater than about 300 rpm.

For the high speed off-balance detection method 40, the controller 116 receives motor speed samples at a predetermined rate, such as one speed sample per revolution. In a motor with one hundred forty-four commutations per revolution, the speed is calculated by measuring the time between one hundred forty-four motor commutations. A relatively slow sampling rate of one speed sample per revolution can be utilized, according to one embodiment, because Hall jitter at high speeds can induce error into speed measurements for fractions of a revolution. Additionally, dynamics of oscillations in the speed of the wash basket 106 caused by unstable cabinet hits are much slower than the angular frequency of the wash basket 106.

Figure 12:
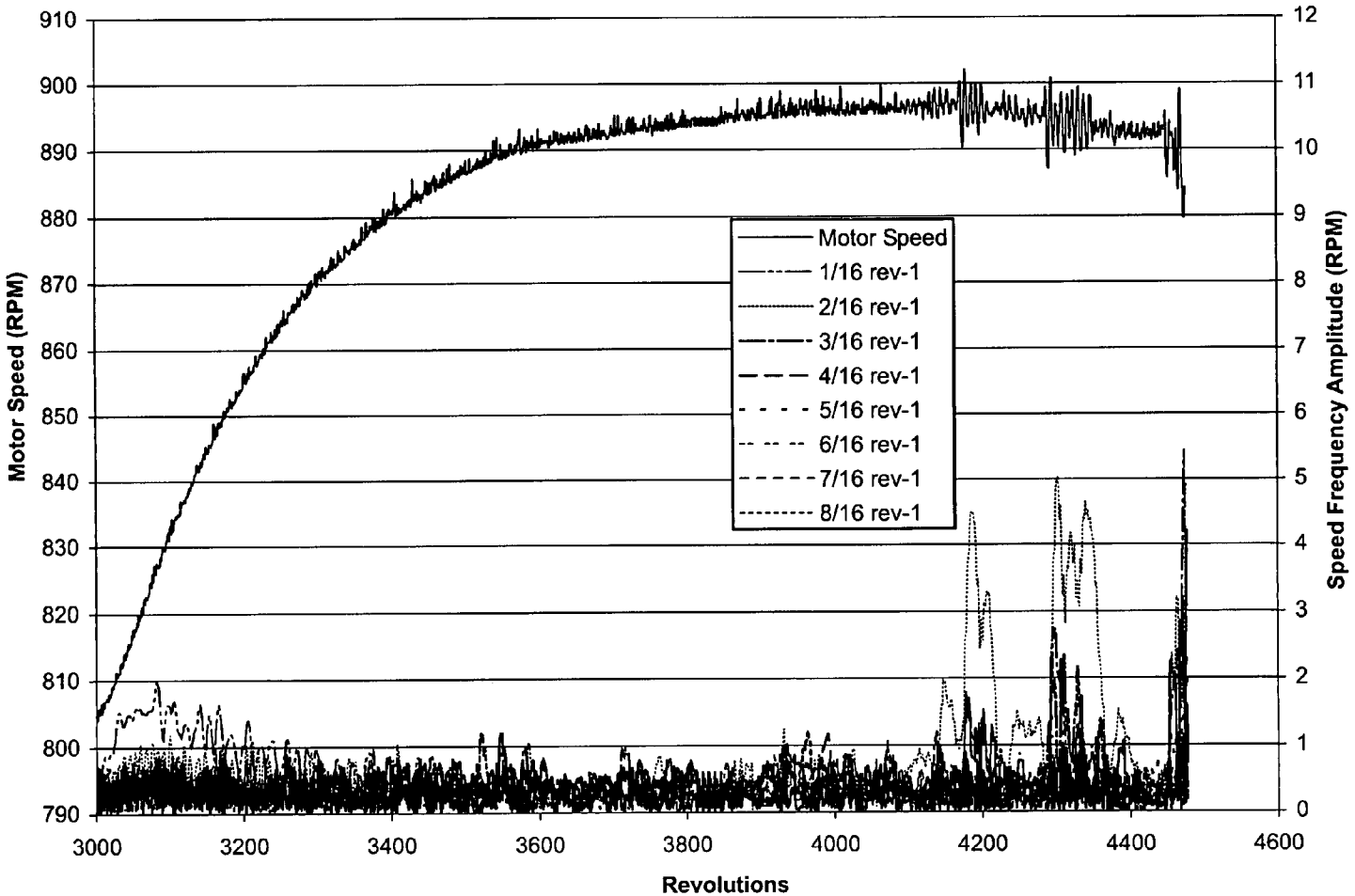
FIG. 12 is a graph illustrating motor speed and corresponding amplitude outputs of a Fast Fourier Transform of the motor speed for an unstable load at a portion of the spin cycle during which the high speed off-balance detection method is active.

Under unstable cabinet hitting conditions, the speed begins to drop and becomes erratic. FIG. 12 shows an exemplary speed profile for a load that was forced unstable. The amplitude outputs, also shown in FIG. 12, of a FFT of the multiple frequency speed signal show that the individual frequency signal for f=2/16 $Rev^{-1}$ (f=1/8 $Rev^{-1}$) dominates during the instability as the cycle approaches 4200 revolutions. Thus, this individual frequency signal of the multiple frequency speed signal can be utilized to detect instability in the high speed range in a manner effectively identical to that described above with respect to the mid-speed off-balance detection method 30, except that the individual frequency signal of 1/8 $Rev^{-1}$ is extracted, and the predetermined amplitude threshold and the predetermined residual threshold correspond to the individual frequency signal of 1/8 $Rev^{-1}$. In another washing machine 10, the dominant frequency has been determined to be f=1/5 $Rev^{-1}$.

As an example, when the method 40 is executed, the controller 116 extracts the individual frequency signal for f=1/8 $Rev^{-1}$ and compares the amplitude of the filtered output signal to a Filter Output Threshold. If the filtered output signal is smaller (i.e., more negative) than the Filter Output Threshold, the absolute value of a difference between the filtered output signal and the Filter Output Threshold is accumulated as an Accumulated Difference. As in the method 30, undesired transient frequency components generated during positive speed accelerations are eliminated by taking the difference between the Filter Output Threshold and negative values of the filtered output signal that are less than the Filter Output Threshold. If the Accumulated Difference exceeds a predetermined Accumulated Difference Threshold, then the load is determined to be off-balance.

Figure 13:
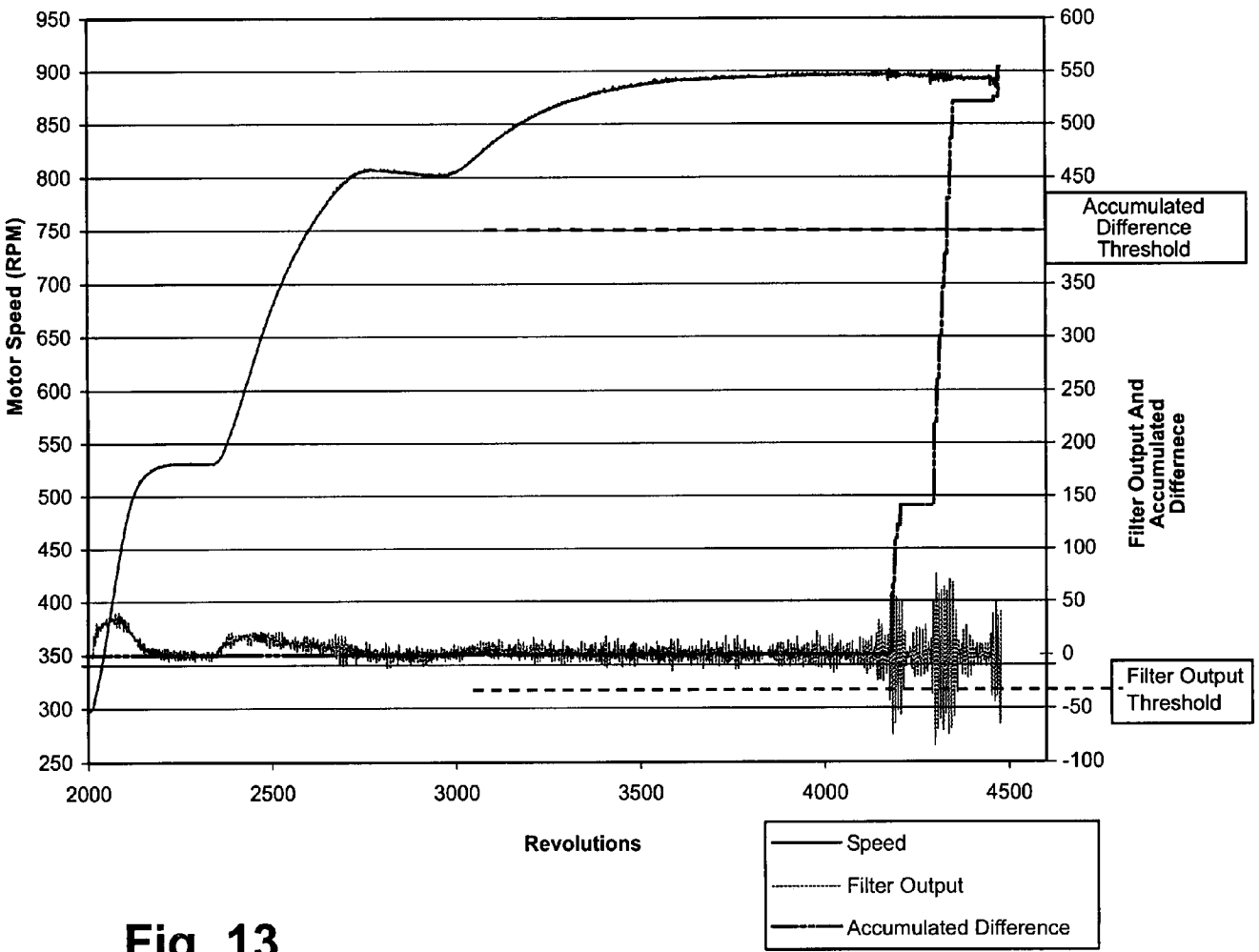
FIG. 13 is a graph showing an exemplary implementation of the high speed off-balance detection method utilizing the $f=\frac{1}{8}\ Rev^{-1}$ signal shown in FIG. 12.

An exemplary speed profile for a spin cycle employing the method 40 is illustrated in FIG. 13. As the washing machine 100 is forced unstable just before 4200 revolutions, the filtered output signal begins to fluctuate heavily, and the Accumulated Difference exceeds the Accumulated Difference Threshold just before about 4400 rpm.

The Filter Output Threshold (i.e., the amplitude threshold) and the Accumulated Difference Threshold (i.e., the residual threshold) for the high speed off-balance detection method 40 can be determined empirically and can differ for different washing machines. Similar to the methods 20, 30, the predetermined amplitude and residual thresholds can be selected to set a desired off-balance sensitivity level. As an example, the Filter Output Threshold can be about −40 rpm, and an exemplary value for the Accumulated Difference Threshold is about 400 rpm.

When the load is determined to be off-balanced during the method 40, the machine can execute the recovery method 60, any other suitable recovery method, or an alternative recovery method 70, which is dependent upon the speed of the wash basket 106 at the time the imbalance is detected. If the wash basket 106 is spinning faster than a predetermined speed, such as 850 rpm, then the wash basket 106 coasts to a stop, and the spin cycle ends. In this case, because the clothes have already been spinning for several minutes, there is no need to require the user to manually rebalance the load and execute the spin cycle again. However, if the wash basket 106 is spinning slower than the predetermined speed, then the spin cycle pauses, and the controller 116 signals to the user, either through a visual or audio signal, for example, that the load is unbalanced and requires user intervention to redistribute the load before the spin cycle can resume.

In addition to the high speed off-balance detection method 40, the power limiting method 50, which can be active at all speeds of the spin cycle and can run in the background of the other methods 20, 30, 40, protects the washing machine 100 against unbalanced loads at high speeds. While off-balance loads can trip the low or mid-speed off-balance detection methods 20, 30 or other off-balance detection methods, some off-balance loads that are not detected or allowed to pass can cause problems at higher spin speeds. These off-balance loads can create increased cabinet vibration, floor vibration, and noise if allowed to spin up to setpoint maximum spin speeds.

The wash basket 106 with an off-balance load requires more power from the motor 110 to reach the setpoint maximum spin speeds than the wash basket 106 with a well-balanced load. As a result, attempting to spin the wash basket 106 with an off-balance load to the setpoint maximum spin speed can overload the motor 110 and damage the washing machine 100. By restricting a maximum power output of the motor 110 in spin, the wash basket 106 with an off-balance load will not be able to reach the setpoint maximum spin speed but will spin only as fast as allowed by the maximum power output. Thus, when the maximum power output of the motor 110 is restricted, the actual maximum spin speed of the wash basket 106 with the off-balance load is less than the setpoint maximum spin speed, thereby protecting the motor 110 from overload.

Because power is a function of torque, the maximum power output can be limited by limiting a maximum torque output, which can be controlled by an advance angle $\alpha$ of the motor 110. Up to a theoretical limit, larger advance angles correspond to greater torque output; therefore, to limit the power available to drive the wash basket 106, the method 50 sets the maximum torque output by setting a maximum advance angle $\alpha$ of the motor 110 during the spin cycle. By example, $\alpha$=85 degrees is considered a standard maximum advance angle of the motor because beyond $\alpha$=85 degrees, the efficiency of the motor 110 drops.

Line voltage from a power line that provides a voltage supply to the motor 110 can greatly impact the operation for the motor 110. Ideally, the line voltage equals a designated line voltage, such as 120 V, utilized to set operating parameters for the motor 110, but, in reality, the line voltage can vary and can differ from the designated line voltage. To normalize the maximum torque output of the motor 110 regardless of the line voltage and thereby avoid overloading the motor 110 when the load is off-balance, the maximum advance angle is set or adjusted based on the line voltage. In general, increases in line voltage correspond to higher maximum torque output for a given advance angle. Therefore, to maintain a desired maximum torque output, the maximum advance angle decreases from the standard maximum advance angle as the line voltage increases. If the maximum advance angle remained constant as the line voltage increased above the designated line voltage, then the maximum torque output would be greater than the desired maximum torque output, thereby potentially leading to an overload of the motor 110.

Figure 14:
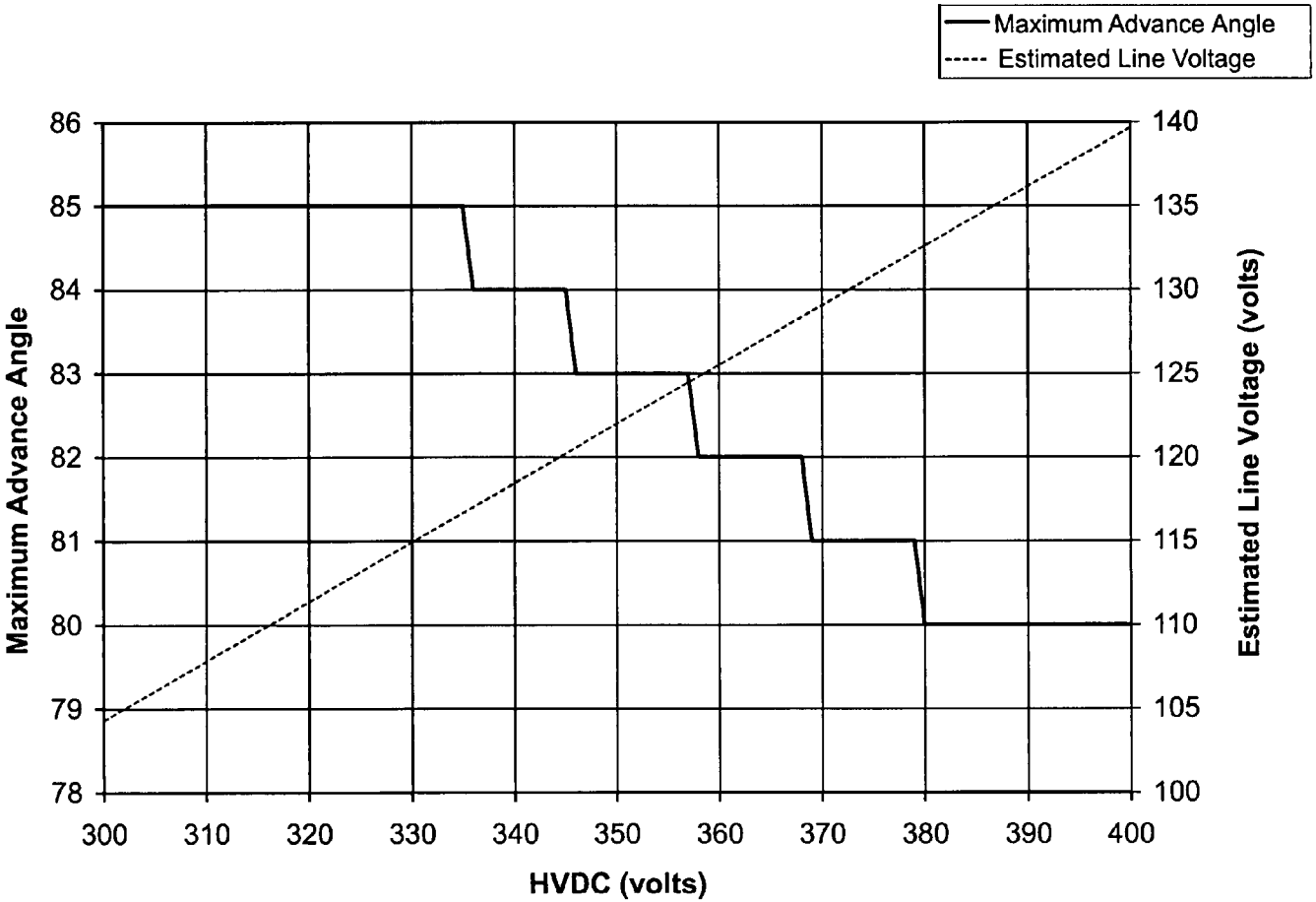
FIG. 14 is a graph illustrating a relationship between HVDC and line voltage and an exemplary relationship between the HVDC and a maximum advance angle for the power limiting method.

The method 50 detects the line voltage early in the spin cycle, such as during a speed plateau (i.e., constant speed). According to one embodiment, the speed at the speed plateau is a low speed, and an exemplary low speed is about 20 rpm. The line voltage is approximated by measuring a DC rail voltage for the motor 110, also known as High Voltage DC (HVDC). The correlation between HVDC and line voltage is illustrated graphically in FIG. 14 and can be mathematically approximated by $$LineVoltage(\text{in RMS units}) = \frac{HVDC(\text{in } DC \text{ units}) - 5}{2\sqrt{2}}$$

It is within the scope of the invention to utilize another equation or relationship for determining line voltage from the HVDC. After the line voltage is determined from the HVDC, the maximum advance angle is set to limit the maximum torque output. The maximum advance angle can be read from an empirically determined look-up table, an example of which is provided in FIG. 15. The table in FIG. 15 provides the maximum advance angle for ranges of HVDC, which is indicative of the line voltage, as described above and shown in FIG. 14.

During operation, the wash basket 106 can only spin as fast as can be achieved with the maximum torque output as limited by the selected maximum advance angle. If the wash basket 106 holds an unbalanced load and requires a greater amount of torque than achievable in view of the maximum advance angle in order to reach the setpoint maximum spin speed, then the wash basket 106 will spin at the actual maximum spin speed less than the setpoint maximum spin speed. As a result, potential damage to the washing machine 100 due to an unbalanced load at high spin speeds is prevented.

Each of the methods 20, 30, 40, and 50 have been described as being employed during ranges of speed, with the ranges for the methods 20, 30, 40 including speeds corresponding to natural frequencies of the mass in the washing machine 10. However, it is within the scope of the invention to utilize the methods 20, 30, 40, and 50 during any suitable speed range, including a speed range that includes the entire speed range of the spin cycle.

While the method 10 has been described above as comprising the individual low, mid-, and high speed off-balance detection methods 20, 30, 40 and the power limiting method 50, it is within the scope of the invention for the method 10 to comprise only one of the methods 20, 30, 40, 50, or a subset of the methods 20, 30, 40, 50. The methods 20, 30, 40, 50 can be utilized alone or in combination with any of the other methods 20, 30, 40, 50. It is also within the scope of the invention for any of the methods 20, 30, 40, 50 to be utilized with methods other than those described above.

Figure 16:
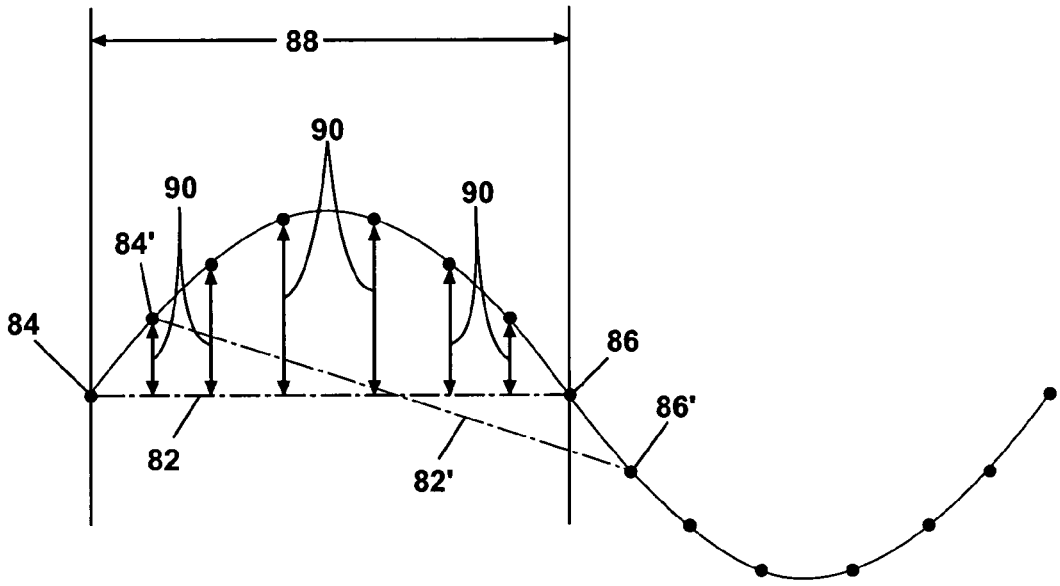
FIG. 16 is a schematic illustration of determining a measure of fluctuation of speed for an alternative off-balance detection method.

An example of an alternative off-balance detection method 80 for use alone or with at least one of the methods 20, 30, 40, or 50 follows. The method 80 can be utilized during a particular speed range, including a speed range that includes the entire speed range of the spin cycle. During the spin cycle, the speed of the wash basket 106 is measured during a sampling window, such as one revolution of the wash basket 106, at a predetermined sampling rate, such as eight speed samples per revolution. Referring now to the schematic illustration in FIG. 16, where the motor speed is represented by a solid line, a reference line 82 is drawn from a first speed sample 84 in the sampling window 88 to a last speed sample 86 in the sampling window 88, and a difference, represented by arrows 90, between each speed sample in the sampling window and the reference line 82 is calculated. The differences 90 are then summed and used to determine if an imbalance exists. For example, the summed difference can be compared to a predetermined threshold to determine if there is an imbalance. Alternatively, the summed difference can be compared to a predetermined threshold, and if the difference exceeds the threshold, then the summed difference is added to an accumulation/residual value. If the accumulation value exceeds an accumulation threshold, then the load is determined to be unbalanced. In the event that the load is unbalanced, the controller 116 can implement a suitable recovery method, shut down the spin cycle, reduce the final spin speed, or perform any other suitable function. If the load is not determined to be unbalanced, then the sampling window shifts, such as by one speed sample, and the method 80 repeats by determining a new reference line 82' between a new first speed sample 84' and a new last speed sample 86'. As an alternative to calculating the differences 90 between the speed samples in the sampling window 88 and the reference line 82, an area between a curve defined by the speed samples and the reference line 82 can be calculated (i.e., integrated), and the area can be processed in a similar manner to determine if an imbalance exists. The method 80 eliminates effects due to gradual acceleration and is, therefore, reliable during acceleration as well as during steady-state conditions or speed plateaus.

The exemplary sampling window given above for the method 80 is one revolution, but a secondary filter of a higher number of revolutions, such as four revolutions, can operate at higher speeds to detect secondary off-balance modes where the wash basket 106 is not hitting the cabinet 104 on every revolution but rather bouncing from one side of the cabinet 104 to the other with a lower frequency.

The methods 20, 30, 40, 50, and 80 have been described for illustrative purposes for use with the exemplary vertical axis washing machine 100 described in the background of the invention. As stated above, the methods 20, 30, 40, 50, and 80 can be used with any suitable washing machine, including any other vertical axis washing machine and any horizontal axis washing machine. Additionally, the washing machine 100 is shown and described with the mass comprising the tub 102 and the wash basket 104 as being suspended from the top of the cabinet 104. It is also within the scope of the invention to utilize, where appropriate, any of the methods described above with a washing machine having a mass supported from the bottom of the cabinet 104 or a washing machine having a hybrid system where the mass is partially supported from the top of the cabinet 104 and partially supported from the bottom of the cabinet 104.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for detecting an off-balance condition of a clothes load in a washing machine comprising a cabinet, within which is mounted a tub, a wash basket within the tub and defining a wash chamber for receiving the clothes load, and a motor for rotating the wash basket about a rotational axis, with a suspended mass formed by the tub, wash basket, motor, and any clothes load in the wash basket, the method comprising:

receiving a speed signal representative of a rotational speed of the wash basket and comprising multiple data points corresponding to predetermined rotational positions of the wash basket sampled over at least one complete revolution of the wash basket;

extracting from the speed signal at least one predetermined frequency signal, where the predetermined frequency signal is reflective of variations of the wash basket speed on a per revolution ($Rev^{-1}$) basis and representative of an off-balance condition of the clothes load;

evaluating the at least one predetermined frequency signal for a presence of an off-balanced condition; and taking an operation action upon determining the presence of the off-balanced condition.

2. The method according to claim 1, wherein the taking the operation action comprises at least one of: shutting down a spin cycle; running a recovery method; and reducing final spin speed of the wash basket.

3. The method according to claim 1, wherein the off-balance condition effects rocking of the wash basket.

4. The method according to claim 1, wherein the predetermined frequency is 1.0 $Rev^{-1}$.

5. The method according to claim 1, wherein the off-balance condition effects top or bottom hits by the wash basket.

6. The method according to claim 1, wherein the predetermined frequency is 0.5 $Rev^{-1}$.

7. The method according to claim 1, wherein the off-balance condition effects hitting of the cabinet by the tub.

8. The method according to claim 1, wherein the predetermined frequency is at least one of ⅛ $Rev^{-1}$ and ⅕ $Rev^{-1}$.

9. The method according to claim 1, wherein the extracting comprises filtering the at least one predetermined frequency signal from a plurality of frequency signals that comprise the speed signal.

10. The method according to claim 1, wherein the speed signal comprises at least two predetermined frequency signals representative of an off-balance condition of the clothes load, wherein each of the predetermined frequency signals corresponds to a different effect of the off-balance condition.

11. The method according to claim 1, wherein the evaluating of the presence of the off-balance condition comprises comparing the at least one predetermined frequency signal to an amplitude threshold.

12. The method according to claim 11, wherein the evaluating of the presence of the off-balance condition further comprises determining a residual from the comparison of the at least one predetermined frequency signal to the amplitude threshold and comparing the residual to a residual threshold.

13. The method according to claim 11, wherein the comparing of the at least one predetermined frequency signal to the amplitude threshold comprises calculating a difference between the amplitude threshold and the at least one predetermined frequency signal.

14. The method according to claim 13, wherein the calculating of the difference occurs when the at least one predetermined frequency signal is less than the amplitude threshold.

15. The method according to claim 1, wherein the speed signal is a speed of the motor.

16. The method according to claim 1, wherein the receiving of the speed signal comprises receiving the speed signal over a predetermined range of speed.

17. The method according to claim 16, wherein the predetermined range of speed comprises speeds corresponding to at least one of a translational natural frequency of the mass and a rotational natural frequency of the mass.

18. A method for detecting an unbalanced condition of a clothes load in a washing machine operated according to a cycle of operation and comprising a cabinet, within which is mounted a tub, a wash basket within the tub and defining a wash chamber for receiving the clothes load, and a motor for rotating the wash basket about a rotational axis, with a suspended mass formed by the tub, wash basket, motor, and any clothes load in the wash basket, the method comprising:

rotating the wash basket;

forming a speed signal representative of the rotational speed of the wash basket by sequentially sampling the rotational speed of the wash basket at predetermined rotational positions of the wash basket over at least one complete revolution of the wash basket;

extracting from the speed signal at least one predetermined frequency signal on a per revolution ($Rev^{-1}$) basis that is associated with an unbalanced condition of the clothes load;

evaluating the at least one predetermined frequency signal for a presence of an unbalanced condition; and altering the cycle of operation upon determining the presence of the unbalanced condition.

* * * * *